US008957292B2

(12) United States Patent
Zeren

(10) Patent No.: US 8,957,292 B2
(45) Date of Patent: Feb. 17, 2015

(54) STRINGED INSTRUMENT WITH BODY INCLUDING FINGERTIP LOCATING FEATURE AND METHODS OF MANUFACTURE

(71) Applicant: Steven J. Zeren, Boulder, CO (US)

(72) Inventor: Steven J. Zeren, Boulder, CO (US)

( * ) Notice: Subject to any disclaimer, the term of this patent is extended or adjusted under 35 U.S.C. 154(b) by 11 days.

(21) Appl. No.: 13/986,747

(22) Filed: Jun. 3, 2013

(65) Prior Publication Data

US 2014/0352517 A1 Dec. 4, 2014

(51) Int. Cl.

| | |
|---|---|
| ***G10D 3/06*** | (2006.01) |
| ***G10D 3/00*** | (2006.01) |
| *G10D 1/08* | (2006.01) |

(52) U.S. Cl.

CPC . *G10D 3/06* (2013.01); *G10D 1/085* (2013.01)

USPC ..... 84/293; 84/291

(58) Field of Classification Search

CPC ..... G10D 1/085; G10D 3/06

See application file for complete search history.

(56) References Cited

U.S. PATENT DOCUMENTS

| | | | | |
|---|---|---|---|---|
| 3,426,638 | A * | 2/1969 | Smith | 84/291 |
| 4,254,683 | A | 3/1981 | Nulman | |
| 4,538,497 | A * | 9/1985 | Smith | 84/291 |
| 5,339,718 | A * | 8/1994 | Leduc | 84/291 |
| 6,791,022 | B2 * | 9/2004 | Green | 84/731 |
| 7,301,085 | B2 | 11/2007 | Wyman | |
| 7,893,330 | B1 * | 2/2011 | Andreasen | 84/291 |
| 8,378,192 | B1 * | 2/2013 | Harmon | 84/291 |
| 2002/0100357 | A1 | 8/2002 | Williams | |
| 2008/0105101 | A1 | 5/2008 | Eldring | |
| 2008/0134859 | A1 * | 6/2008 | Shelton | 84/267 |
| 2008/0202309 | A1 | 8/2008 | Wiswell | |
| 2011/0219932 | A1 | 9/2011 | Gembar | |
| 2014/0116226 | A1 * | 5/2014 | Saito et al. | 84/291 |

* cited by examiner

*Primary Examiner* — Robert W Horn

(74) *Attorney, Agent, or Firm* — Harold A. Burdick

(57) ABSTRACT

A stringed instrument having a body assembly including a fingertip locating feature is disclosed together with methods of manufacturing the instrument. The instrument body is characterized by a bottom surface, a top surface, and a bridge mounting location at the top surface adjacent to a heel end of the body. A neck connection interface end is located opposite the heel end, a string sounding area defined between the interface end and the bridge mounting location. The body assembly has at least a first underpitched feature extending a selected distance between the ends adjacent to the string sounding area.

20 Claims, 17 Drawing Sheets

STRINGED INSTRUMENT WITH BODY INCLUDING FINGERTIP LOCATING FEATURE AND METHODS OF MANUFACTURE

FIELD OF THE INVENTION

This invention relates to stringed instruments and instrument manufacture, and more particularly relates to stringed instruments having various features enhancing instrument playability and maneuverability.

BACKGROUND OF THE INVENTION

Stringed instrument designs and manufacturing techniques are ancient and varied and have changed in many respects over the years. Variations in instrument design have included those directed to enhanced playability, ease of manufacture, and/or tonality of the instrument (see U.S. Patent Application Publication Nos. 2002/0100357, 2008/0202309, 2008/0105101, and 2011/0219932, and U.S. Pat. Nos. 4,254,683 and 7,301,085). Such design features have, over time, either become accepted features of various types of instruments or fallen by the wayside.

In particular, guitars of all types (acoustic or electric) have undergone dramatic change throughout their history, and a great many more suggested design features and alterations have heretofore been suggested and/or utilized and then abandoned. Moreover, changing techniques and styles of playing guitars have been and continue to be developed that in themselves may suggest design changes.

For example, at present, finger location and stability for certain types of picking and strumming often require fairly awkward manipulation of the instrument and/or positioning of the hand. Heavier instruments may dictate periodic lifting to relieve the player of shoulder fatigue during performances. Certain musical passages or styles of playing may dictate guitar repositioning during performance. Techniques such as so-called "harmonic picking", produced by striking a guitar string with the tip of a guitar pick and simultaneously the skin of the thumb holding the pick, requires precise positioning of the hand, made more difficult by its suspension over the strings. Likewise, precise location of the palm for string muting while finger picking is made difficult because of the required hand positioning and lack of support in such position. Performing these precision harmonic picking methods can be quite difficult while at the same time changing fingerboard positions, guitar position, weight shifting and the like.

As may be appreciated, further design changes adapted to evolving playing techniques could thus still be utilized.

SUMMARY OF THE INVENTION

This invention provides a stringed instrument having a body including a fingertip locating (or guide or anchoring) feature and methods of making the instrument. The instrument includes a carved or adapted feature providing an elongated underpitched fingertip groove or notch adjacent to the string sounding area at the top surface of the instrument body on the lower, or treble, side. This feature provides the musician with a fingertip anchoring point along its entire length, providing enhanced control over the instrument, for example (in the case of a guitar) while flat picking or fingertip picking. In addition the feature provides a means to lift or otherwise maneuver the guitar for relieving or shifting the instrument's weight and/or repositioning the instrument. The feature is particularly useful for guitar players, allowing for position anchoring during performance of various techniques which would otherwise require hard to locate suspension of the hand above the strings and/or quite awkward hand and arm positioning.

The instrument includes a neck having a fingerboard and an instrument body assembly. The body assembly includes a body having a bottom surface, a top surface, a bridge at the top surface adjacent to a heel end, and a neck connection interface end opposite the heel end for connection with the neck. A bass side and a treble side of the instrument body each extend between the ends and a string sounding area is defined between the sides and between the interface end and the bridge. The string sounding area is located to be colineal with the fingerboard of the neck. The body assembly is particularly characterized by at least a first underpitched feature extending along the treble side a selected distance adjacent to the string sounding area.

The underpitched feature for fingertip location of this invention is adaptable to all types of stringed instruments, but perhaps is best adapted for use with electric guitar and bass body assemblies (for example, of the type utilizing spaced pickups). The steps of the methods of this invention for making the body assemblies of this invention include shaping material to establish a body including a bottom surface, a top surface, a bridge mounting location at the top surface adjacent to a heel end, a neck connection interface end opposite the heel end, and bass and treble sides extending between the ends. The string sounding area is thus defined between the sides and between the interface end and the bridge mounting location. An underpitched feature is establishing at the top surface extending along the treble side a selected distance adjacent to the string sounding area thereby providing a fingertip locating structure.

It is therefore an object of this invention to provide a stringed instrument having a body including a fingertip locating feature and methods of making the instrument.

It is another object of this invention to provide a stringed instrument that includes a feature carved or otherwise located at the top surface of the instrument providing an elongated underpitched fingertip groove or notch adjacent to the string sounding area on the lower, or treble, side.

It is yet another object of this invention to provide a stringed instrument body that provides the musician with a fingertip anchoring point along a selected length adjacent to the strings to accommodate enhanced control over the instrument, It is still another object of this invention to provide a stringed instrument body having a feature utilizable to lift or otherwise maneuver the instrument.

It is yet another object of this invention to provide a guitar body that accommodates finger position locating during performance of various techniques.

It is another object of this invention to provide a stringed instrument that includes an instrument neck having a fingerboard, and an instrument body assembly including a bottom surface, a top surface, a bridge at the top surface adjacent to a heel end, a neck connection interface end opposite the heel end and connected with the instrument neck, a bass side extending between the ends, a treble side extending between the ends, and a string sounding area defined between the sides and between the interface end and the bridge and located to be colineal (extending substantially along the same line) with the fingerboard of the neck, the body assembly further characterized by at least a first underpitched feature extending along the treble side a selected distance adjacent to the string sounding area.

It is still another object of this invention to provide an electric guitar body assembly adapted for installation of spaced pickups and including a bottom surface, a top surface, a bridge mounting location at the top surface adjacent to a heel end, a neck connection interface end opposite the heel end, a string sounding area defined between the interface end and the bridge mounting location, the body assembly further characterized by at least a first underpitched feature extending a selected distance between the ends adjacent to the string sounding area.

It is yet another object of this invention to provide a method for making a stringed instrument body assembly that includes the steps of shaping material to establish a body including a bottom surface, a top surface, a bridge mounting location at the top surface adjacent to a heel end, a neck connection interface end opposite the heel end, a bass side extending between the ends, a treble side extending between the ends, and a string sounding area defined between the sides and between the interface end and the bridge mounting location, and establishing an underpitched feature extending along the treble side a selected distance adjacent to the string sounding area thereby providing a fingertip locating structure.

With these and other objects in view, which will become apparent to one skilled in the art as the description proceeds, this invention resides in the novel construction, combination, and arrangement of parts and methods substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
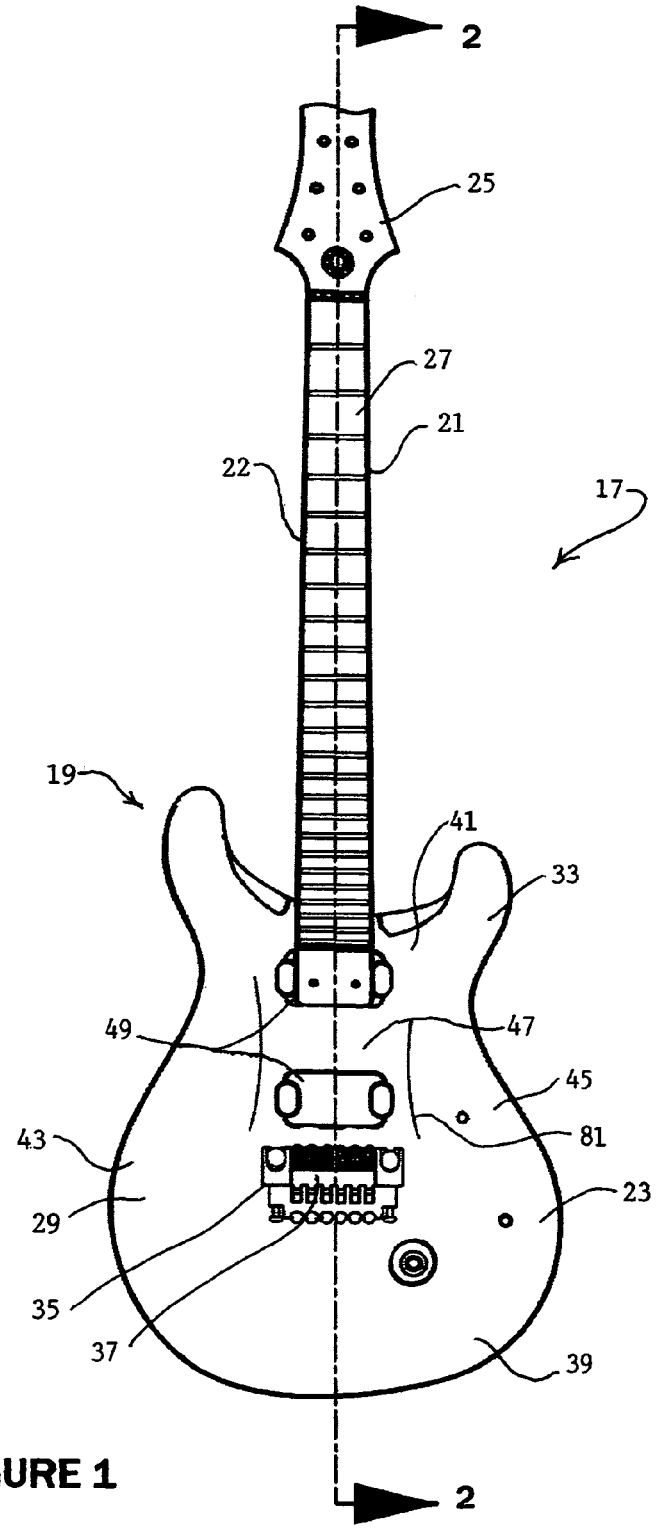
FIG. 1 is a top view of a stringed instrument, a guitar in this illustration, showing a first embodiment of this invention.
Figure 2:
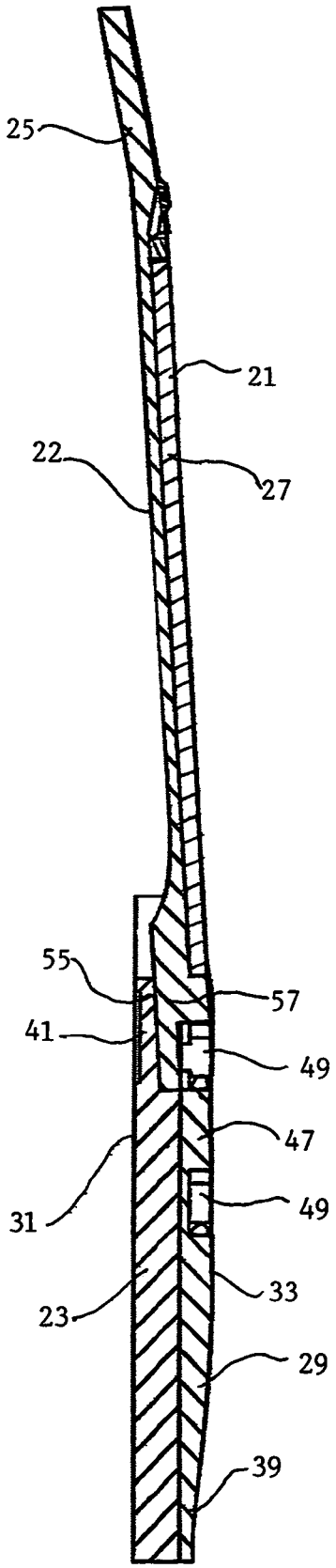
FIG. 2 is a partial sectional view (bridge removed) taken through section lines 2-2 of FIG. 1.

The drawings illustrate different embodiments and applications of this invention. While the stringed instruments shown in the drawings are various types of electric guitar (carved top and flat top, two pickup assembly designs) it should be realized that the features of this invention can be utilized with a variety of categories and types of stringed instruments (guitars of all types, acoustic and electric, including arch tops, carved or formed tops, flat tops, classical, single or multi-pickup, as well as acoustic or electric bass guitars and many other stringed instrument types).

A first embodiment 17 of a stringed instrument 19 of this invention is illustrated in FIGS. 1 through 8 (a carved top electric guitar is shown). Instrument 19 includes neck assembly 21 (including neck 22) and body assembly 23. Neck assembly 21 includes tuning peg head 25 at one end of neck 22 and fingerboard 27 (a fret board as shown in the FIGURE) mounted at a top surface thereof. Body assembly 23 includes body 29 which may be of either single piece design (a monolithic carved or formed top) or multi-piece design (including a body piece with a carved or formed top piece glued thereto). Assembly 23/body 29 includes bottom surface 31 (see FIG. 2) and top surface 33 with bridge mounting location 35 thereat (see FIG. 3) for receipt of a bridge 37 (see also FIG. 9). Bridge 37, once installed, is thus located at top surface 33 adjacent to heel end 39 of body assembly 23, a neck connection interface end 41 of body assembly 23 located opposite heel end 39. Interface end 41 is configured as illustrated hereinafter (see FIGS. 3 and 5) for connection of neck assembly 21 thereto, bass side 43 of assembly 23/body 29 (the upper side of the guitar as played adjacent to the largest gauge, and thus tonally lowest, string) and treble side 45 of assembly 23/body 29 (the lower side of the guitar as played adjacent to the smallest gauge, and thus tonally highest, string) extending between ends 39 and 41 of body 29. String sounding area 47 is defined between sides 43 and 45 and between interface end 41 and bridge mounting location 35 (and thus bridge 37). Sounding area 47 is located to be colineal with fingerboard 27 of neck assembly 21.

Body assembly 23 is formed with pickup pockets 49 (one at each side of string sounding area 47 in a two pickup design) for receipt of electronic pickups (active or passive) therein. Various tone and volume controls 51 and a guitar cable output jack are mounted at body 29 (see FIG. 3) with wiring thereto routed within body 29 to the pickups (and accessible through wiring pocket cover 53 at bottom surface 33—see FIG. 8). Neck mounting pocket 55 (see FIGS. 2, 3 and 5) is configured for receipt of neck mounting end 57 therein (a bolt-on design shown, though a set neck design could also be employed). In the case of a bolt-on neck, connector or connectors 59 (one shown in FIG. 5) are received through connector opening(s) 61 at body 29 and neck end 57 for attaching neck assembly 21 to body assembly 23. Body 29 includes recessed formation 63 in bottom surface 31 adjacent to neck connection opening(s)

Figure 5:
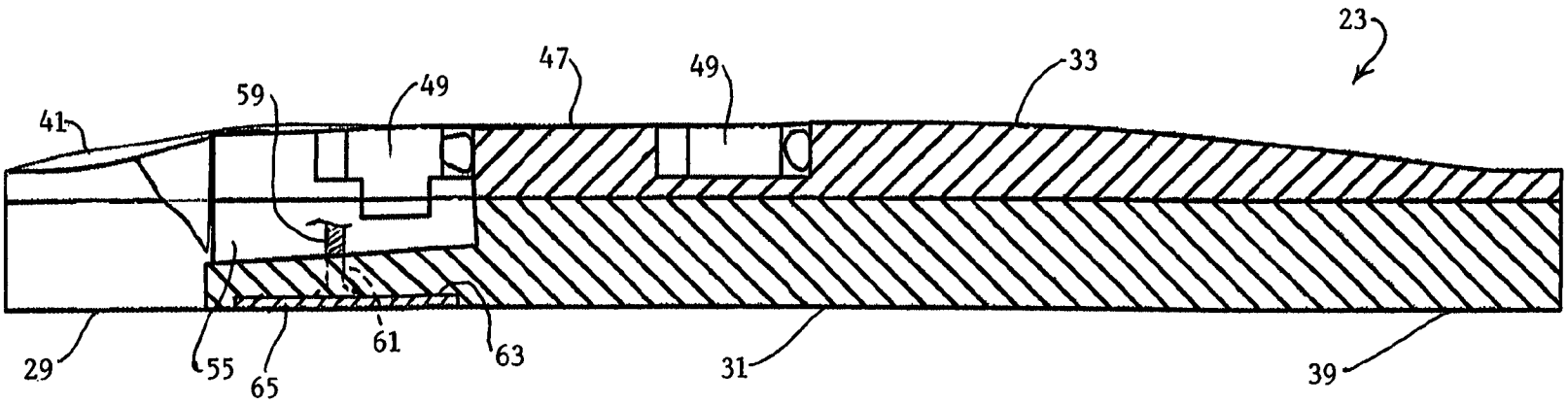
FIG. 5 is a sectional view taken through section lines 5-5 of FIG. 3.
Figure 8:
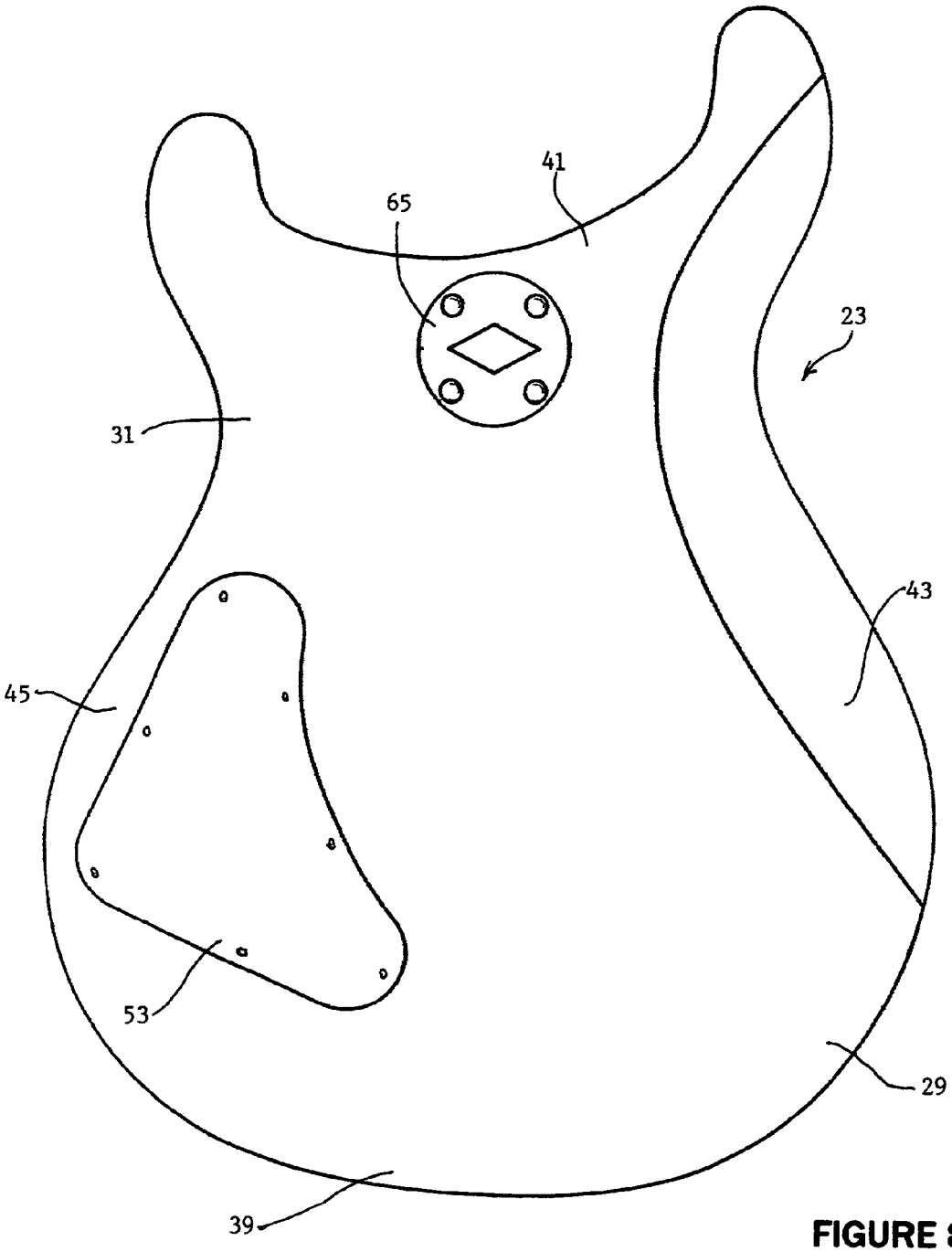
FIG. 8 is a bottom view of the body assembly of FIG. 3.
Figure 9:
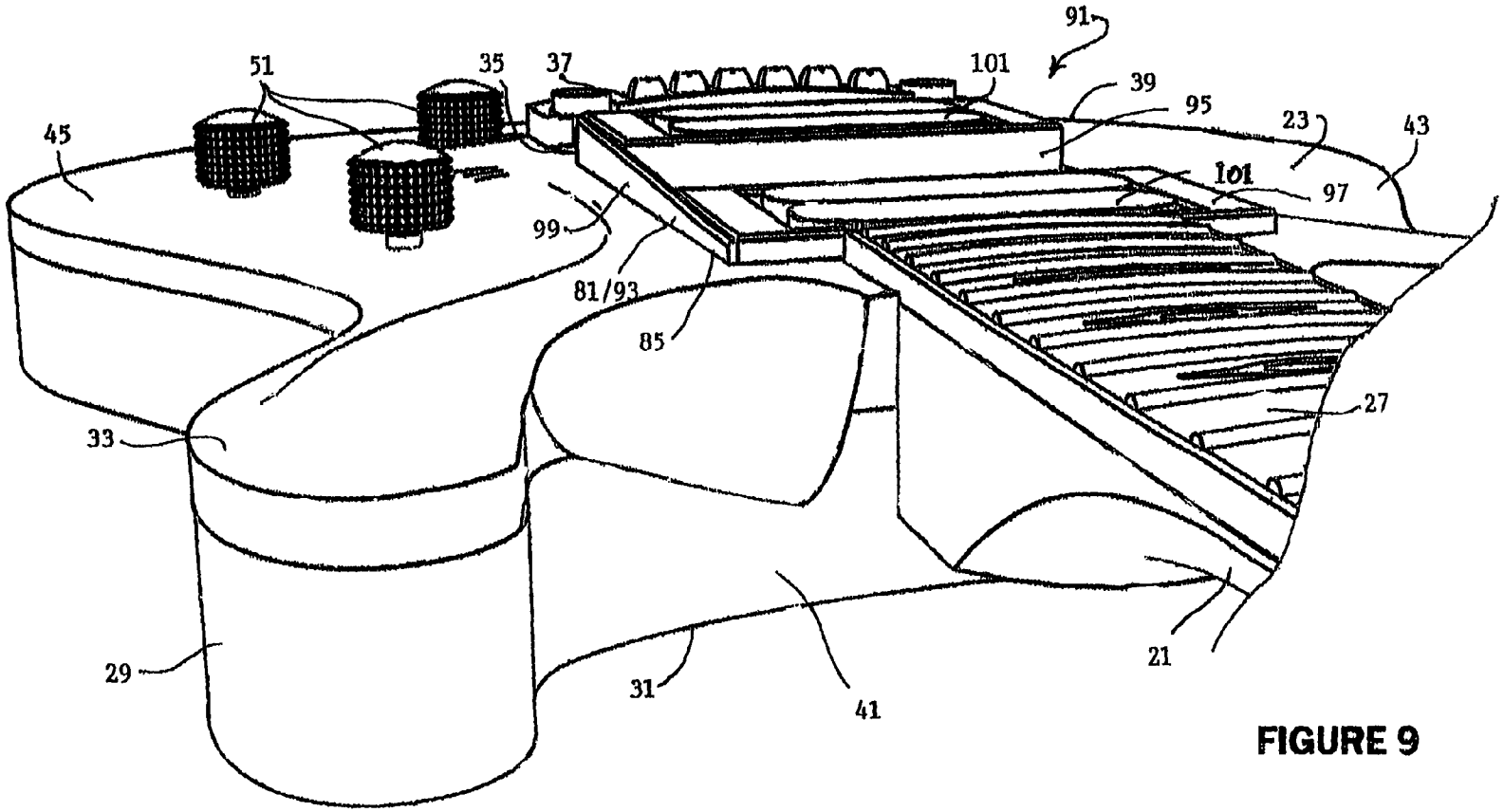
FIG. 9 is a top perspective view of a stringed instrument (a carved top electric guitar) illustrating a second embodiment of this invention.
Figure 10:
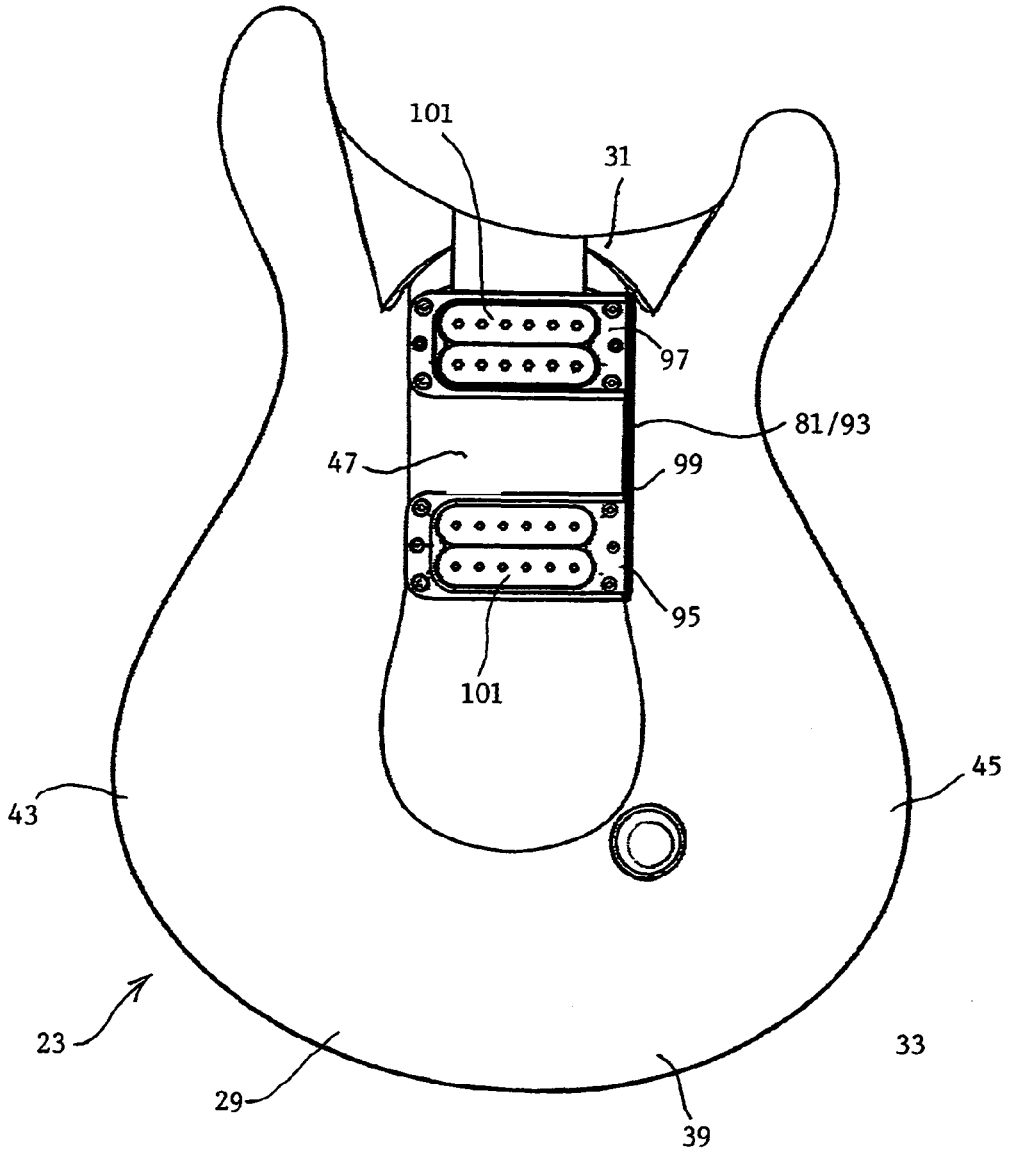
FIG. 10 is a top view of a body assembly of the stringed instrument of FIG. 9.

61 through body 29 configured for flush mounting receipt and securement of cover plate 65 therein (see FIGS. 5 AND 8). Recessing plate 65 prevents it from catching on the musician's clothing, belt or the like.

Figure 6:
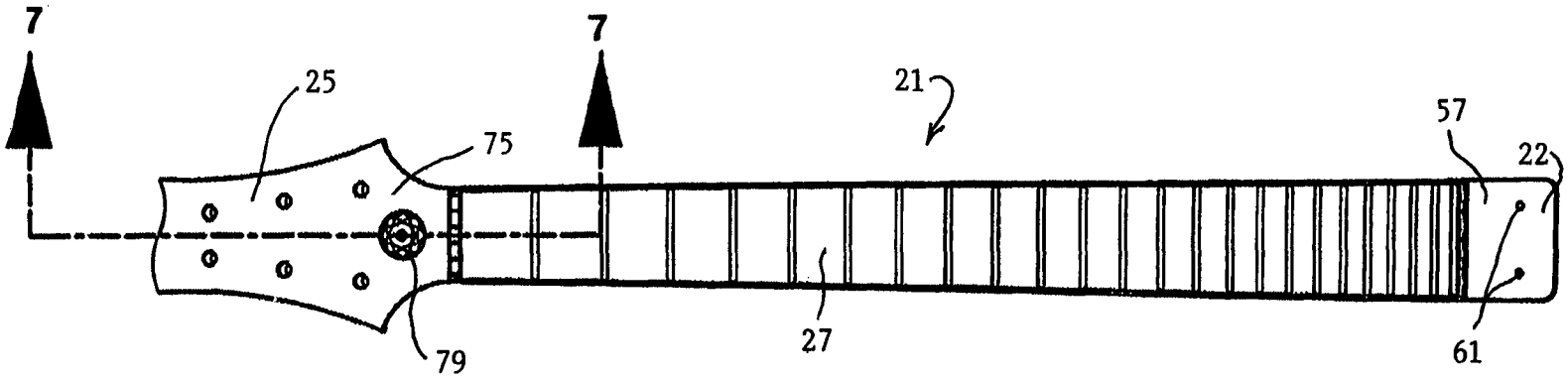
FIG. 6 is a top view of a neck assembly of the stringed instrument of FIG. 1.
Figure 7:
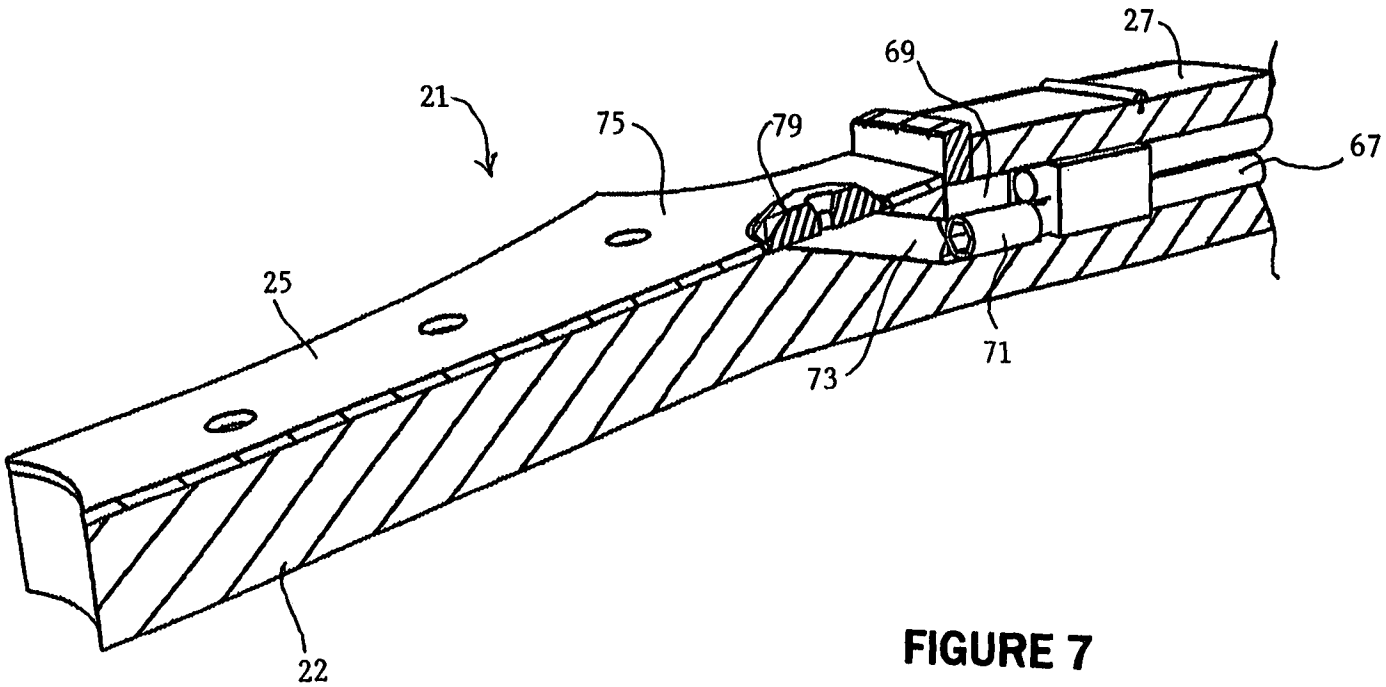
FIG. 7 is a perspective sectional view taken through section lines 7-7 of FIG. 6.

As shown in FIGS. 6 and 7, neck assembly 21 includes truss rod 67 installed in a linear bore 69 the length of neck 22. Rod 67 includes adjustment head 71 for receipt of a standard tool (in this case an Allen wrench receivable in the faceted head 71). Truss rod access bore 73 extends at an angle of between about 20° and 25° from top surface 75 of head 25 to linear bore 69. This allows truss rod access bore 73 to be of a minimum diameter for receipt of a standard tool (for example a 4 mm ball tipped Allan wrench) while yet maintaining tool functionality at adjustment head 71 (i.e., the angle of the access bore is well within the appropriate tool design tolerance range for the ability of ball tipped Allen wrench to provide adequate torque and turn the truss rod easily without stripping or binding). This angled access design minimizes material removal for a headstock accessed truss rod of the type shown herein, and thereby strengthens neck 22 at head 25. Truss rod access cover 79 decoratively covers the opening to bore 73 at top surface 75.

Figure 3:
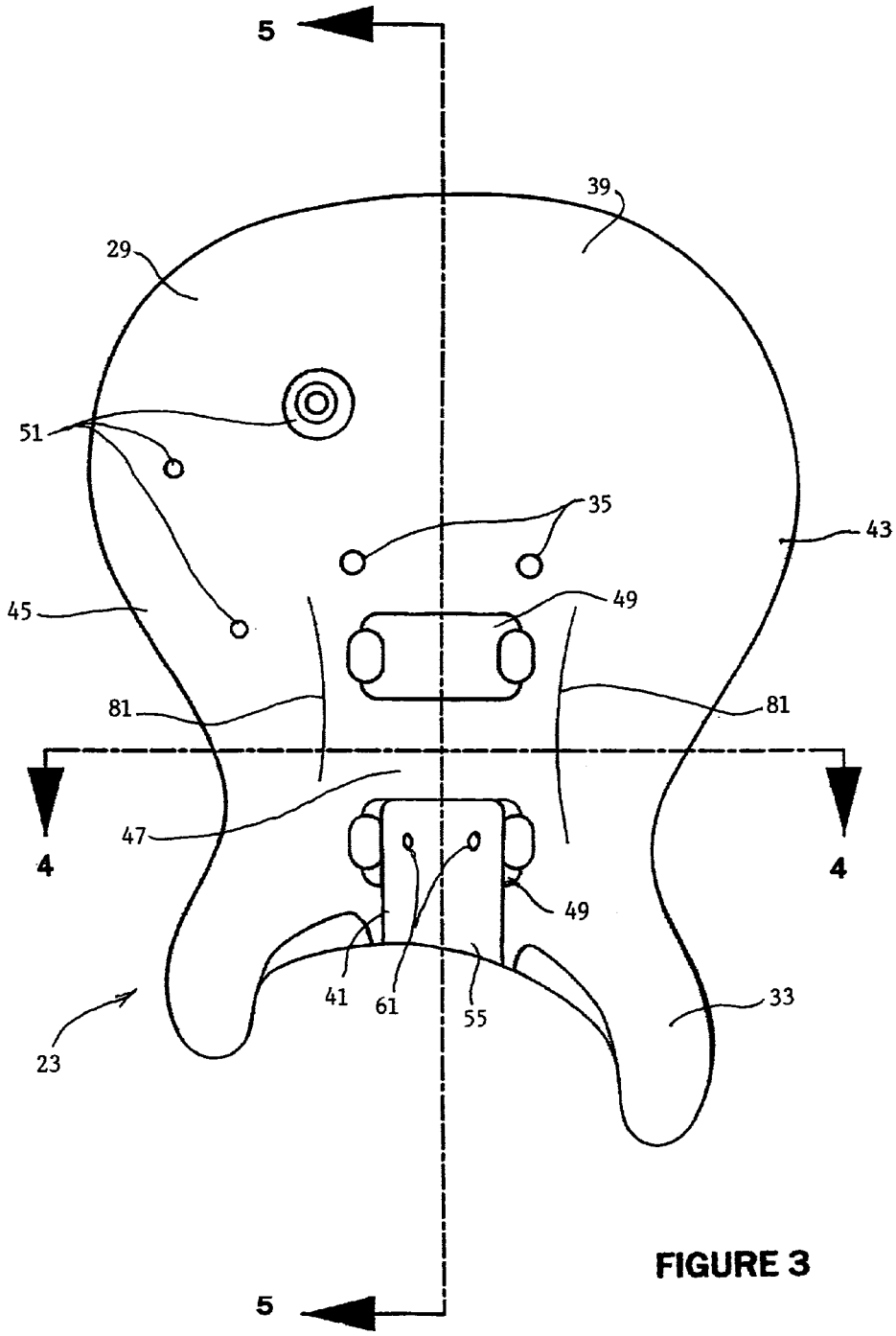
FIG. 3 is a top view of a body assembly of the stringed instrument of FIG. 1.
Figure 4:
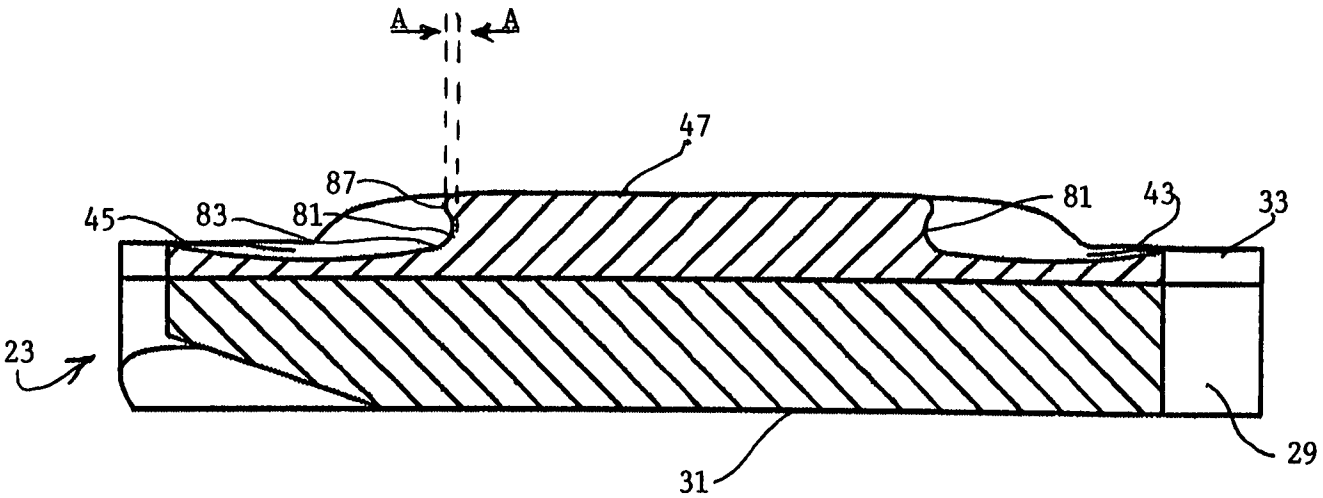
FIG. 4 is a sectional view taken through section lines 4-4 of FIG. 3.
Figure 11:
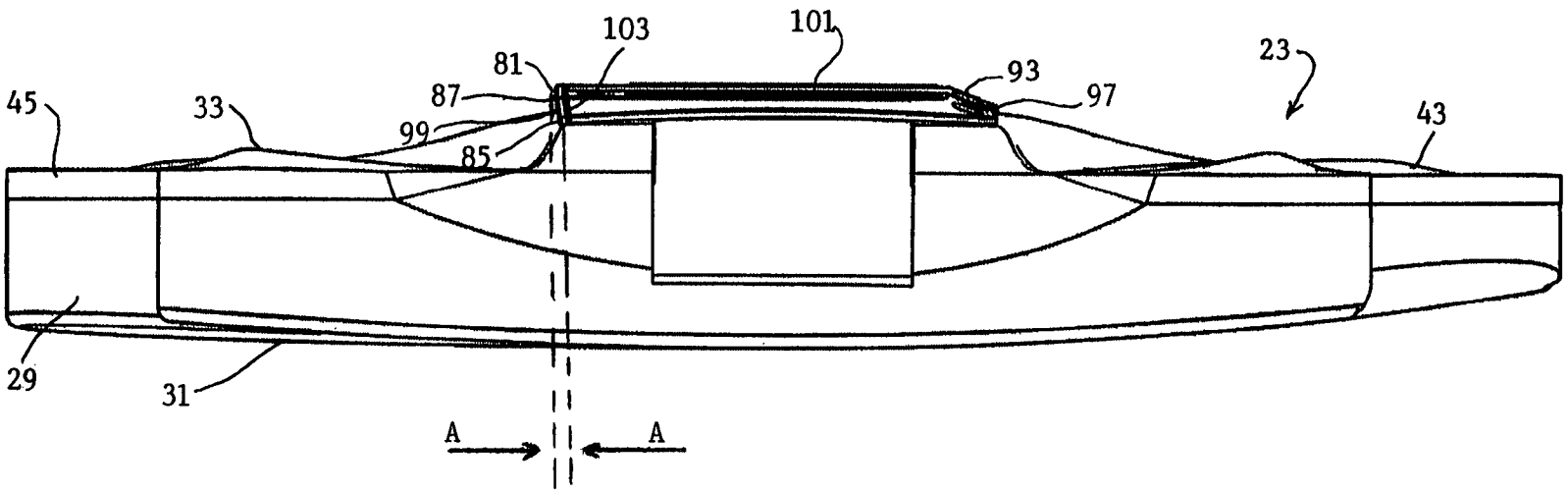
FIG. 11 is an end view of the body assembly of FIG. 10.
Figure 12:
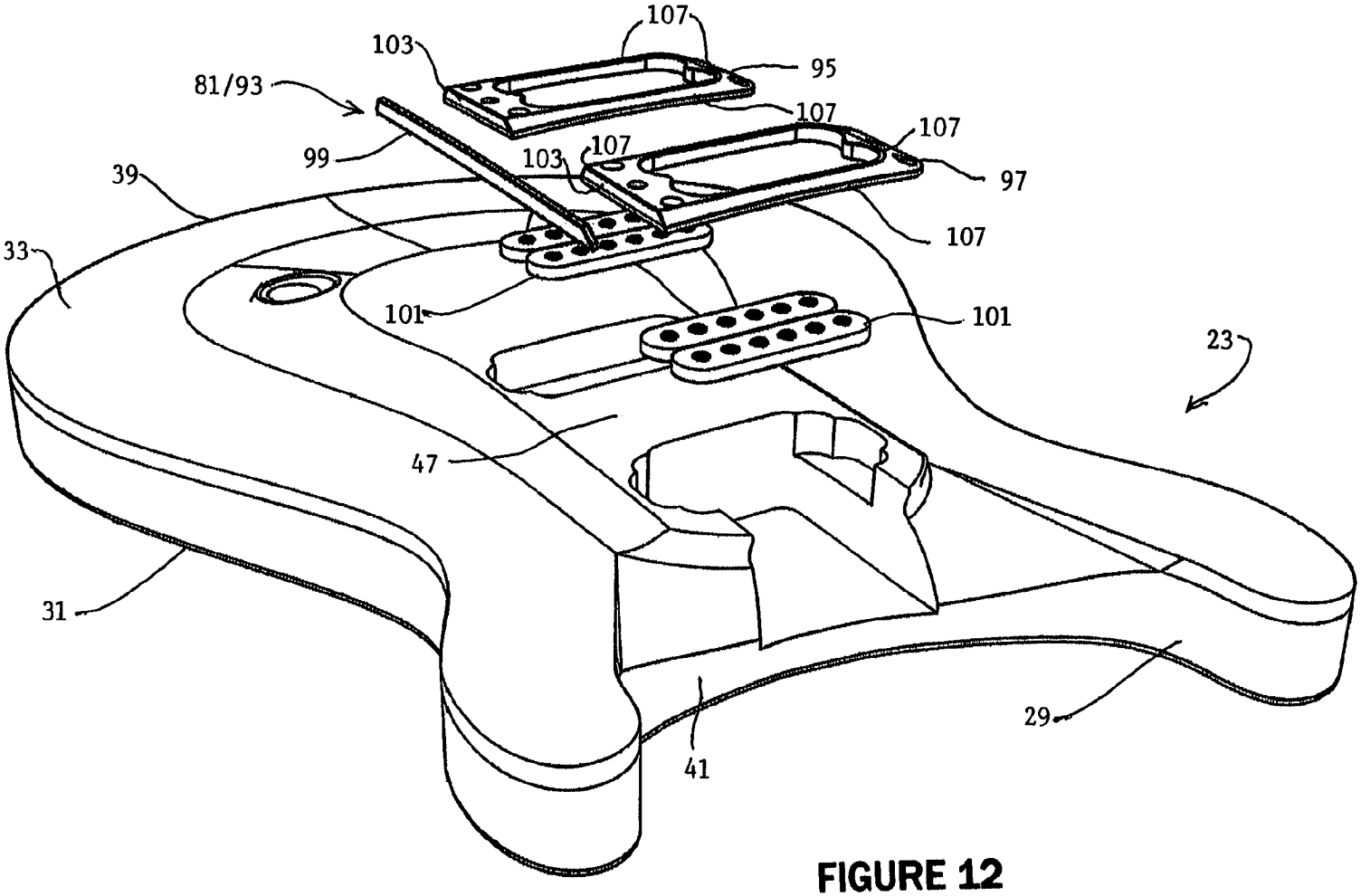
FIG. 12 is a perspective exploded view of the body assembly of FIG. 10.
Figure 13:
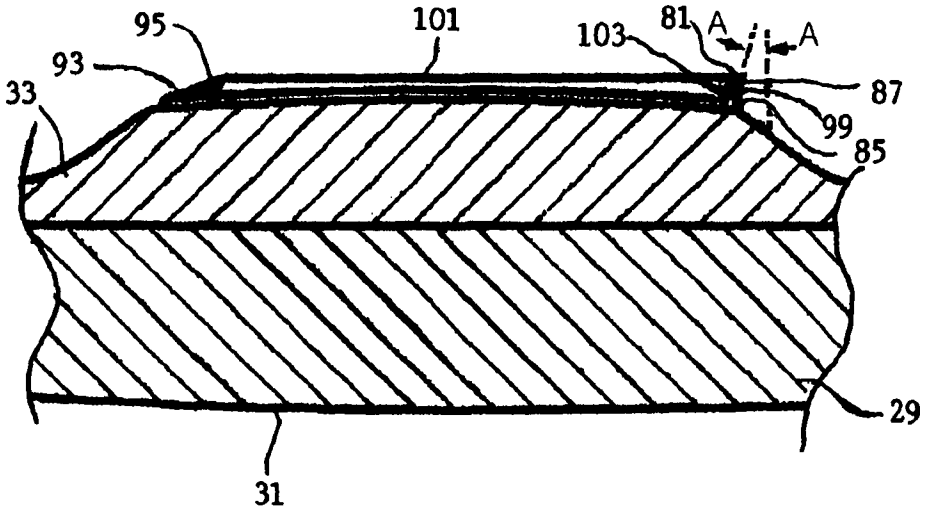
FIG. 13 is a partial section view of a body assembly in accord with the second embodiment of this invention.

As shown in FIGS. 3 and 4, body assembly 23 is characterized by at least a first underpitched feature 81 (two are shown, with only the feature at treble side 45 of body 29 being essential to many of the playability and maneuverability enhancements achieved by this invention). Feature 81 extends along treble side 45 a selected distance adjacent to string sounding area 47. The term "underpitched" as used herein is intended to mean any structure (such as an undercut groove, slope or the like) or structural addition (such as a pitched guide, anchor, locating feature or the like) that creates a groove 83 or notched area 85 (see FIGS. 11 and 13) having an overhanging structural component.

Underpitched feature 81 of the type shown in FIGS. 1 through 8 is defined by an undercut groove 83 formed in the body material of top surface 33 of instrument body assembly 23/body 29. Feature 81 defines an overhanging structure 87 defining an underpitch amount A-A of between about 1 mm and 3 mm (preferably about 2 mm) at the base of the feature and forming an underpitched angle of between about 5° and 15° degrees (preferably about 10° overall) from a line normal to top surface 33 (see also, for application in another embodiment, FIGS. 11 and 13). Underpitched feature 81 is configured to conform to contour of the pickup plane (defined by the location and arrangement of the pickups in and on the body) and design contours of guitar body assembly 23/body 29.

Figure 14:
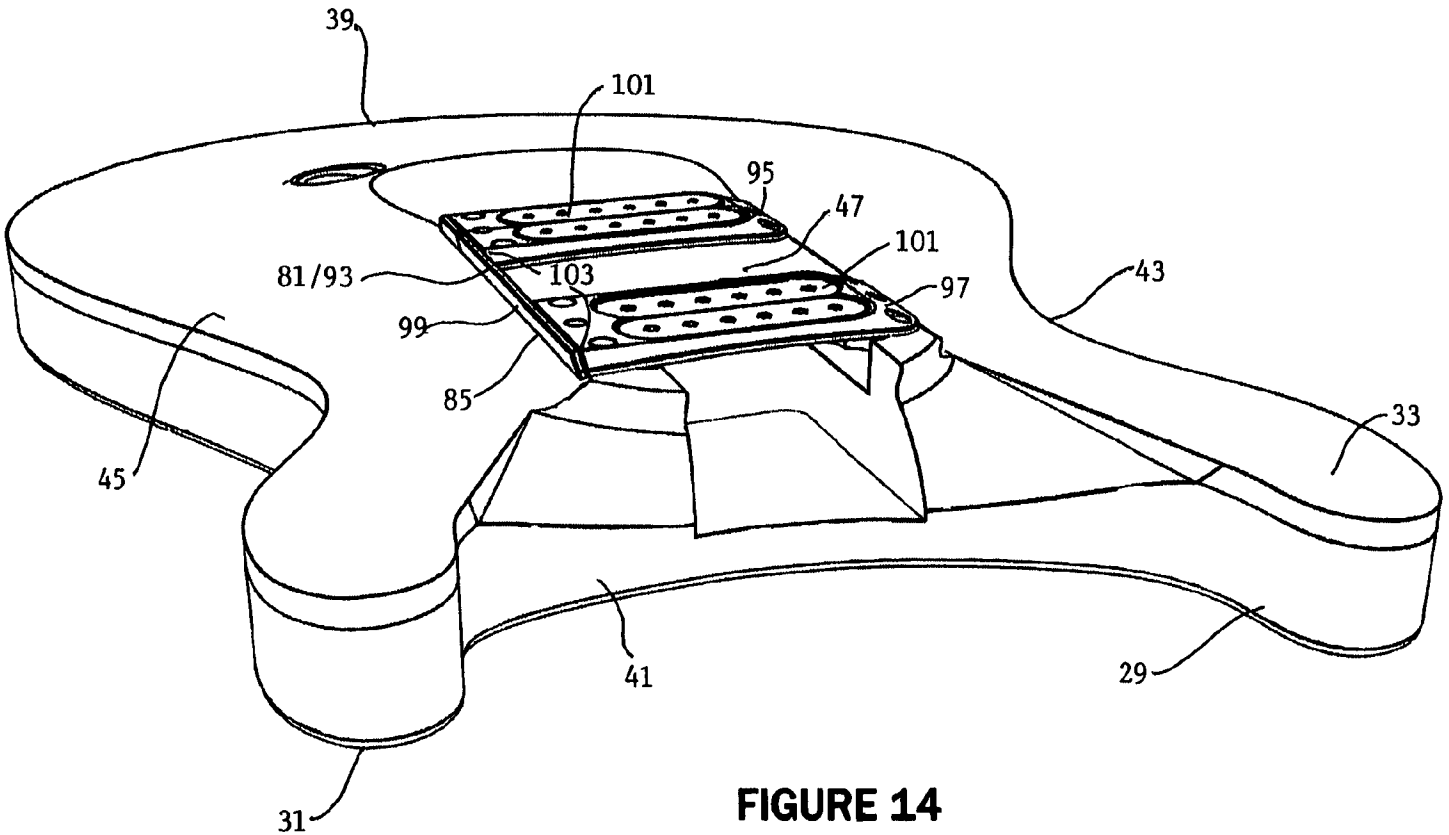
FIG. 14 is a top perspective view of another type of stringed instrument body assembly (a flat top electric guitar body assembly) utilizing features of the second embodiment of this invention.

Turning now to FIGS. 9 through 14, second embodiment 91 of the underpitched feature 81 of this invention is shown (on a carved top electric guitar in FIGS. 9 through 13 and on a flat top, or slab body, electric guitar in FIG. 14). A great many features of this embodiment are the same as shown in embodiment 17, and identifying numbers common to both embodiments have been retained, the following addressing only the differences of embodiment 91 and underpitched feature 81. Feature 81 of embodiment 91 may be utilized on many different styles of instrument, both carved (i.e., contoured) and flat top designs (as particularly shown in FIG. 14).

Pickup ring assembly 93 includes first and second spaced pickup rings 95 and 97 with projection 99 (a wall, or ledge) extending therebetween (fewer or more rings may be used depending upon the number of pickups in the particular implementation) and having a canted surface at notch area 85 defined using any of the techniques discussed hereinbelow. Ring assembly components are all mounted (using standard connectors and/or slotted or machined structures at top surface 33 of body 29) adjacent to string sounding area 47 and around pickups 101 (thus hold pickups adjustably in place as is standard). Each of rings 95 and 97 includes a canted ring wall 103, projection 99 orientation established by the angle of canted ring walls 103. Projection 99 is configured to extend from top surface 33 substantially coextensively with the height of ring walls 103, this arrangement thereby canting projection 99 establishing underpitched feature 81 having elongated notch area 85 beneath overhanging structure 87 (formed by the cant of projection 99, see FIGS. 11 and 13) along adjacent sounding area 47 and rings 95 and 97. As before, the defined projection is canted at an angle of between about 5° and 15° (preferably about 10°) relative to a line normal to top surface 33 of body 29, with an underpitch amount A-A of between about 1 mm and 3 mm (preferably about 2 mm) at the base of the feature. Pickup rings 95 and 97 preferably include contoured top surface portions 107 adjacent three sides thereof (see FIG. 12).

Ring assembly 93 may be reversely mounted at surface 33 (i.e., rotated) 180° with feature 81 positioned at bass side 43 of body 29 for thumb positioning (especially desired by some players of bass guitars). Moreover, ring assembly 93 could be made with canted ring walls at both sides of rings 95/97 and provided with an opposite side projection 99 mounted adjacent thereto to accommodate both finger and thumb positioning using features 81 at both the bass and treble sides 43 and 45. While projection 99 is shown being canted, it could be formed with a canted surface as shown below for use in the forgoing embodiment.

Figure 15:
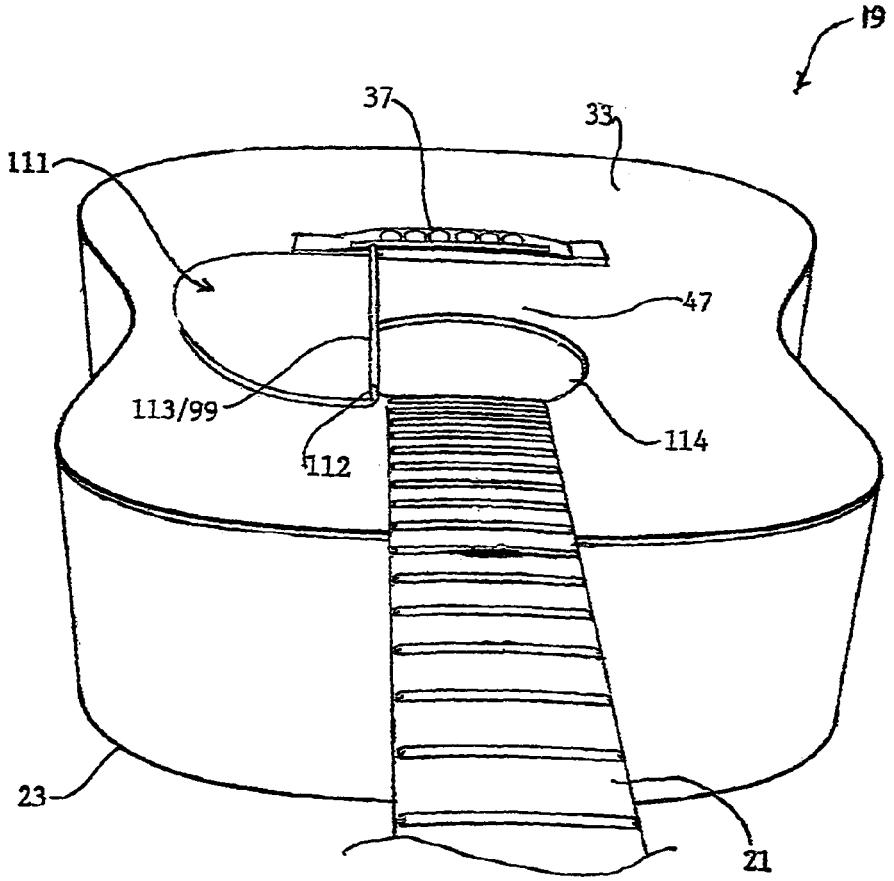
FIG. 15 is a partial perspective view of a stringed instrument (an acoustic guitar) illustrating a third embodiment of this invention.
Figure 16:
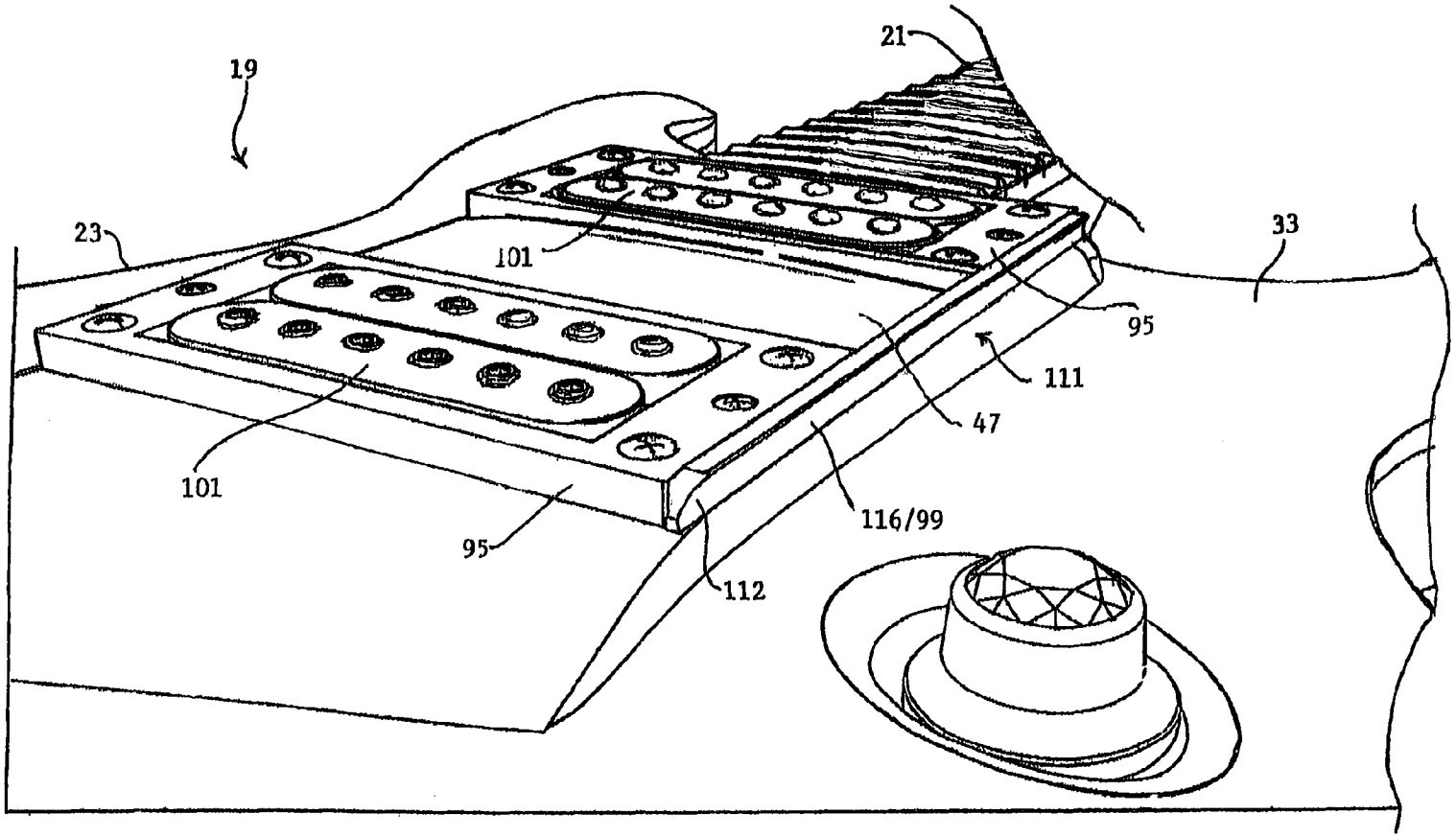
FIG. 16 is a partial perspective view of a stringed instrument (a carved top electric guitar) illustrating another approach to the third embodiment of this invention shown in FIG. 15.
Figure 17:
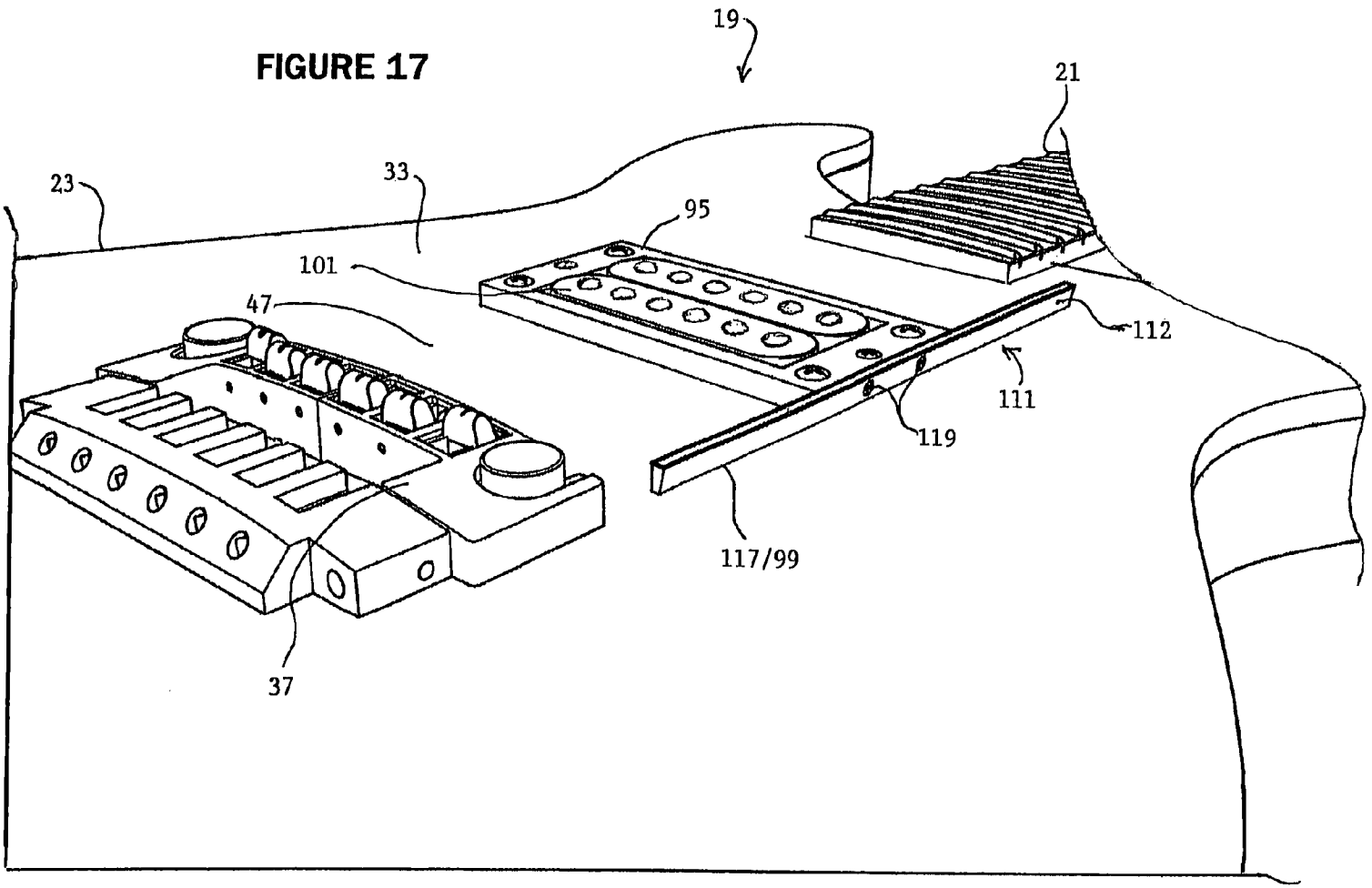
FIG. 17 is a partial perspective view of a stringed instrument (a flat top electric guitar) illustrating yet another approach to the third embodiment of this invention shown in FIG. 15.

Projection 99 could be adapted for separate deployment in cases of retrofitting to guitars and/or pickup ring(s) already in place on a guitar as illustrated by embodiment 111 of this invention shown in FIGS. 15 through 17. In such case projection 99 would be formed with canted surface 112 canted at an angle of between about 5° and 15°, for example by having an overall trapezoidal cross-section with the desired cant disclosed herein being created by varying the thickness of the projection from its top (thicker) to its bottom (thinner). Alternatively, projection 99 could have a virtual trapezoidal cross-section where the projection is formed with the selected angle defined by material bending or other such formation—a modified "L" with the leg (and thus surface 112) and the bass at an acute or obtuse angle to one another thereby defining the cant.

FIG. 15 shows projection 113/99 mounted on instrument 19 (a flat top acoustic guitar) having a sound hole 114 at string sounding area 47. This approach to embodiment 111 uses a projection made of appropriate material suitable to this application on an acoustic guitar (preferably wood, bone, plastic or the like glued to the top surface of the guitar). The projection may be either a separate element or, as shown herein, integrally formed with pick guard 115. FIG. 16 shows projection 116/99 mounted adjacent to string sounding area 47 of instrument 19 (a carved top electric guitar) and having an arcuate surface 112 along its length to accommodate the guitar's body style and/or pickup plane arrangement. Projection 116/99 in this approach is made of any suitable material (extruded plastic, for example) and is mounted using known technique suitable to the task (glued, screwed, mounted in a slot formed in the guitar top, or the like for example). Projection 117/99 shown in FIG. 17 illustrates another approach adapted to application adjacent to string sounding area 47 of instrument 19 (a flat top electric guitar, in this case of single pickup design). This approach again may utilize any suitable material (such a metal, plastic, bone, wood or the like) attached in any manner adapted for such securement (glue, slots, and the like could be used, the approach as shown using screws 119). When used with a single pickup design, the material selected for projection 99 should be of sufficient stiffness to be durably manipulable at both ends without separation from the instrument.

Manufacture is preferably performed utilizing a computer aided design (CAD) program to generate a 3D digital full scale model of the stringed instrument body, as well as various tooling fixtures. More particularly, computer aided machining (CAM) generates tool paths (g-code) that in turn is read into a CNC milling machine's control interface program. The control program interprets the g-code and coordinates the machine's X, Y, and Z axis to perform the actual machining process. The machine's Z axis utilizes a spindle motor and tool holding collets for the various milling cutters or router bits that cut and remove the material, and progressively shape and carve the various surface features and pocketing. Additional hand sanding techniques are performed in preparation for adding color or stain and final spray finishing.

The machining process specific to underpitched feature 81 of FIGS. 1 through 8 requires a somewhat complex curve to be created and a tool path generated along that curve forming undercut groove 83 of between 1 to 3 mm (preferably about 2 mm) and an arcuate undercut overall angel of between about 5° and 15° (preferably about 10)°. Currently a carbide ball burr cutter with a ⅜ inch diameter ball and ¼ inch shank is utilized to perform underpitched feature 81, followed by light hand sanding. Groove 83 is formed to follow the contour of the pickup plane (in either a radial or parallel fashion) to the guitars design contours, its pickups and pickup rings.

The manufacture requires shaping tone material (typically select woods) to establish a body including the bottom surface, top surface, bridge mounting location, and heel end, neck connection interface end, bass side, treble side, and string sounding area contours. The underpitched feature is formed extending along the treble side a selected distance adjacent to the string sounding area thereby providing a fingertip locating structure. Establishment of the underpitched feature may require carving an undercut groove in the tone material at the top surface of the instrument body in the case of first embodiment 17, with the groove formation thus defining the overhanging structure and selected underpitch amount. In the case of embodiment 91, manufacture simply requires formation in the tone material of the mounting openings for pickups and ring assembly 93 and mounting of the ring assembly at the string sounding area. The ring assembly may be made of any known material utilized for such purposes or generally utilized in instrument construction of the type upon which mounting is to occur. Preferably such structures are formed in metal or plastic and mounted with the projection extending as desired from the top surface of the body with the underpitched feature defined by selectively forming the canting of the ring walls so that the projection cants at the selected angle thus defining the elongated notch area adjacent to the string sounding area.

Body and neck materials used are preferably wood of various species which are commonly used for the manufacture of the particular stringed instruments. In some cases plastics may be used in which case formation of the various structures and features may be by injection molding. The canted projection of the pickup ring assembly can be a separate structural feature from the rings or may be formed integrally therewith.

As may be appreciated from the foregoing, an instrument design is provided which includes features for enhancing playability and maneuverability of the instrument. The features may be adapted to a large variety of stringed instrument categories and types.

What is claimed is:

1. A stringed instrument comprising:

an instrument neck including a fingerboard; and an instrument body assembly including a bottom surface, a top surface, a bridge at said top surface adjacent to a heel end, a neck connection interface end opposite said heel end and connected with said instrument neck, a bass side extending between said ends, a treble side extending between said ends, and a string sounding area defined between said sides and between said interface end and said bridge and located to be colineal with said fingerboard of said neck, said body assembly further characterized by at least a first underpitched feature extending along said treble side a selected distance adjacent to said string sounding area.

2. The instrument of claim 1 wherein said underpitched feature is defined by an undercut groove formed in body material of said top surface of said instrument body assembly.

3. The instrument of claim 1 wherein said underpitched feature defines an overhanging structure defining an underpitch amount of between about 1 mm and 3 mm.

4. The instrument of claim 1 wherein said neck includes a head, a truss rod installed in a linear bore the length of said neck, and a truss rod access bore extending at an angle of between about 20° and 25° from a top surface of said head to said linear bore thereby minimizing material removal from said head while allowing adjustment access to said truss rod using standard tools.

5. The instrument of claim 1 further comprising at least a first connector for attaching said neck to said body assembly through at least a first connector opening adapted for receipt thereof, said body including a recessed formation at said bottom surface adjacent to said neck connection interface end and having said connector opening thereat, said instrument further comprising a cover plate adapted for installation at said recessed formation thereby providing a flush mounting of said plate at said bottom surface.

6. The instrument of claim 1 further comprising a projection extending from said top surface, said underpitched feature defined by said projection having a canted surface at an angle of between about 5° and 15° relative to a line normal to said top surface to thereby define an elongated notch area adjacent to said string sounding area.

7. The instrument of claim 6 further comprising a pickup ring assembly mounted at said string sounding area and including said projection, wherein said pickup ring assembly may be reversely mounted thus establishing said underpitched featured along said bass side of said body assembly.

8. An electric guitar body assembly adapted for installation of spaced pickups comprising a bottom surface, a top surface, a bridge mounting location at said top surface adjacent to a heel end, a neck connection interface end opposite said heel end, a string sounding area defined between said interface end and said bridge mounting location, said body assembly further characterized by at least a first underpitched feature extending a selected distance between said ends adjacent to said string sounding area.

9. The assembly of claim 8 wherein said underpitched feature is formed at and angle of about 5° to 15° relative to a line normal to said top surface.

10. The assembly of claim 8 further comprising spaced pickups installed at said top surface and establishing a pickup plane thereat, and wherein said underpitched feature is configured to conform to contour of said pickup plane and design contours of said guitar body assembly.

11. The assembly of claim 8 wherein said underpitched feature is defined by an undercut groove formed in body material of said top surface of said body assembly defining an overhanging structure establishing an underpitch amount of between about 1 mm and 3 mm.

12. The assembly of claim 8 further comprising a projection extending from said top surface, said underpitched feature defined by said projection having a canted surface relative to a line normal to said top surface to thereby define an elongated notch area adjacent to said string sounding area.

13. The assembly of claim 12 further comprising a pickup ring assembly mounted at said string sounding area and including first and second spaced pickup rings with said projection extending therebetween, wherein said pickup rings include canted ring walls, said canted surface of said projection orientation established at an angle of between about 5° and 15° by said canted ring walls.

14. The assembly of claim 13 wherein said pickup rings include contoured top surface portions adjacent three sides of said pickup rings.

15. The assembly of claim 12 wherein said angle is preferably about 10°.

16. A method for making a stringed instrument body assembly comprising the steps of:

shaping material to establish a body including a bottom surface, a top surface, a bridge mounting location at said top surface adjacent to a heel end, a neck connection interface end opposite said heel end, a bass side extending between said ends, a treble side extending between said ends, and a string sounding area defined between said sides and between said interface end and said bridge mounting location; and establishing an underpitched feature extending along said treble side a selected distance adjacent to said string sounding area thereby providing a fingertip locating structure.

17. The method of claim 16 wherein the step of establishing an underpitched feature includes the step of carving an undercut groove in said material at said top surface of said instrument body.

18. The method of claim 17 wherein the step of carving an undercut groove includes defining thereby an overhanging structure with an underpitch amount of between about 1 mm and 3 mm.

19. The method of claim 16 wherein the step of establishing an underpitched feature includes mounting a projection extending from said top surface of said body when mounted, said underpitched feature defined by canting a surface of said projection at an angle of between about 5° and 15° relative to a line normal to said top surface to thereby define an elongated notch area adjacent to said string sounding area.

20. The method of claim 19 further comprising the step of forming a pickup ring assembly and mounting said pickup ring assembly at said string sounding area, the step of forming said pickup ring assembly including forming first and second pickup rings having said projection extending therebetween, canting one wall of each of said pickup rings, and establishing degree of cant of said projection utilizing said canted ring walls.

* * * * *